US011417455B2

(12) United States Patent
Inaba et al.

(10) Patent No.: US 11,417,455 B2
(45) Date of Patent: Aug. 16, 2022

(54) REACTOR AND MAGNETIC CORE FOR REACTOR

(71) Applicants: AutoNetworks Technologies, Ltd., Yokkaichi (JP); Sumitomo Wiring Systems, Ltd., Yokkaichi (JP); Sumitomo Electric Industries, Ltd., Osaka (JP)

(72) Inventors: Kazuhiro Inaba, Yokkaichi (JP); Xiaoguang Zheng, Osaka (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 758 days.

(21) Appl. No.: 16/335,100

(22) PCT Filed: Sep. 5, 2017

(86) PCT No.: PCT/JP2017/031942
§ 371 (c)(1),
(2) Date: Mar. 20, 2019

(87) PCT Pub. No.: WO2018/056049
PCT Pub. Date: Mar. 29, 2018

(65) Prior Publication Data

US 2019/0237237 A1 Aug. 1, 2019

(30) Foreign Application Priority Data

Sep. 21, 2016 (JP) ..... JP2016-184616

(51) Int. Cl.
*H01F 27/24* (2006.01)
*H01F 27/26* (2006.01)
(Continued)

(52) U.S. Cl.
CPC ..... *H01F 27/263* (2013.01); *H01F 27/255* (2013.01); *H01F 27/2823* (2013.01); *H01F 37/00* (2013.01)

(58) Field of Classification Search
CPC ..... H01F 27/2823; H01F 27/263
(Continued)

(56) References Cited

U.S. PATENT DOCUMENTS 5,053,738 A * 10/1991 Sato ..... H01F 38/10 336/215
6,876,161 B2 * 4/2005 Chung ..... H05B 41/2822 336/221
(Continued)

FOREIGN PATENT DOCUMENTS

JP H7263262 A 10/1995
JP H8107023 A 4/1996
(Continued)

OTHER PUBLICATIONS

International Search Report, Application No. PCT/JP2017/031942, dated Nov. 28, 2017.

*Primary Examiner* — Ronald Hinson
(74) *Attorney, Agent, or Firm* — Honigman LLP

(57) ABSTRACT

Provided is a reactor including: a coil including two wound portions obtained by winding a winding wire; and a magnetic core in which the wound portions are arranged. The magnetic core includes: inner leg portions arranged inside the inner peripheries of the wound portions; a central leg portion provided between the wound portions; two outer leg portions that are provided outside the outer peripheries of the wound portions and between which the inner leg portions and the central leg portion are provided; and two coupling portions between which the inner leg portions, the central leg portion, and the outer leg portions, which are
(Continued)

arranged in parallel, are sandwiched and with which these portions are coupled.

16 Claims, 5 Drawing Sheets

(51) Int. Cl.
*H01F 27/28* (2006.01)
*H01F 37/00* (2006.01)
*H01F 27/255* (2006.01)

(58) Field of Classification Search
USPC ..... 336/212
See application file for complete search history.

(56) References Cited

U.S. PATENT DOCUMENTS 7,446,640 B2 * 11/2008 Saito ..... H01F 27/326 336/212
7,456,719 B2 * 11/2008 Suzuki ..... H01F 38/10 336/198
7,612,640 B2 * 11/2009 Sano ..... H01F 27/255 336/83
8,242,870 B1 * 8/2012 Folker ..... H01F 27/255 336/83
9,721,716 B1 * 8/2017 Folker ..... H01F 27/24
2005/0068149 A1 * 3/2005 Fushimi ..... H01F 38/08 336/208
2005/0073385 A1 * 4/2005 Wu ..... H01F 27/325 336/208
2007/0091519 A1 * 4/2007 Abe ..... H02J 50/40 361/38
2008/0088403 A1 * 4/2008 Suzuki ..... H01F 38/10 336/198
2008/0211616 A1 * 9/2008 Suzuki ..... H01F 38/08 336/182

FOREIGN PATENT DOCUMENTS

JP 200193737 A 4/2001
JP 2016122760 A 7/2016
WO 2015068265 A1 5/2015

* cited by examiner

REACTOR AND MAGNETIC CORE FOR REACTOR

CROSS-REFERENCE TO RELATED APPLICATIONS

This application is the U.S. national stage of PCT/JP2017/031942 filed on Sep. 5, 2017, which claims priority of Japanese Patent Application No. JP 2016-184616 filed on Sep. 21, 2016, the contents of which are incorporated herein.

TECHNICAL FIELD

The present disclosure relates to a reactor and a magnetic core for a reactor.

BACKGROUND

A reactor is one of the components used in a circuit that boosts/lowers a voltage. JP 2016-122760A discloses two types of reactors for an in-vehicle converter that have different shapes.

One of the reactors, namely a reactor 1α, includes a coil including two tubular wound portions obtained by spirally winding a winding wire, and a magnetic core formed in an O-shape by assembling a pair of U-shaped split cores (FIGS. 1 and 2 in JP 2016-122760A). The two wound portions are connected such that magnetic fluxes passing through the respective wound portions flow in opposite directions when an electric current is applied to the coil.

The other of the reactors, namely a reactor 1β, includes a coil including one tubular wound portion obtained by spirally winding a winding wire, and a magnetic core obtained by assembling a pair of E-shaped split cores (FIGS. 4 and 5 in JP 2016-122760A). This magnetic core (also referred to as "EE core" hereinafter) includes a middle leg (inner core portion 31) that is arranged inside the inner circumference of the wound portion, a pair of side legs that is arranged on the outer circumference of the wound portion and between which the middle leg is provided, and two coupling portions that connect the middle leg and the two side legs in a state in which the middle leg and the side legs are sandwiched between the coupling portions.

The above-described reactor 1α is likely to be saturated with magnetism when an electric current applied to the coil is increased. There is a possibility that a predetermined inductance cannot be ensured due to a decrease in inductance caused by magnetic saturation. A large current is desired for in-vehicle use, and reactors that are less likely to be saturated with magnetism even when a larger electric current is applied thereto and with which a decrease in inductance caused by magnetic saturation is easily suppressed are desired.

When the number of turns in the wound portion of the above-described reactor 1β is increased in order to ensure a predetermined inductance, there are cases where the footprint of the reactor 1β increases and a height (also referred to as "installation height" hereinafter) of the reactor 1β from an placement surface of an installation target to which the reactor is to be attached increases. For example, when the reactor is arranged such that the axial direction of the coil extends in parallel with the above-mentioned placement surface (FIG. 4 in JP 2016-122760A; this layout may be called a horizontal layout hereinafter), the footprint is likely to increase. Alternatively, for example, when the reactor is arranged such that the axial direction of the coil extends so as to intersect the above-mentioned placement surface at a right angle (this layout may be called a vertical layout hereinafter), the installation height is likely to increase. From these viewpoints, the size of the reactor is likely to increase in both cases. Therefore, reactors that are small in size even when the number of turns in the wound portion is increased are desired.

It is desirable that reactors are small in size and less likely to be saturated with magnetism. Also, magnetic cores that can be used to form such reactors are desired.

Accordingly, one of the objects is to provide a reactor that is small in size and is less likely to be saturated with magnetism. Another object is to provide a magnetic core for a reactor that can be used to form a reactor that is small in size and is less likely to be saturated with magnetism, and the like.

SUMMARY

A reactor of the present disclosure includes a coil including two wound portions obtained by winding a winding wire and a magnetic core in which the wound portions are arranged. The magnetic core includes an inner leg portion arranged inside inner peripheries of the wound portions; a central leg portion provided between the wound portions; two outer leg portions that are provided outside outer peripheries of the wound portions and between which the inner leg portions and the central leg portion are provided; and two coupling portions between which the inner leg portions, the central leg portion, and the outer leg portions, which are arranged in parallel, are sandwiched and with which these portions are coupled.

A magnetic core for a reactor of the present disclosure is a magnetic core for a reactor to which a coil including two wound portions obtained by winding a winding wire is assembled, and the magnetic core includes an inner leg portion arranged inside inner peripheries of the wound portions. A central leg portion is arranged apart from the inner leg portions and is provided between the inner leg portions. Two outer leg portions are arranged apart from the inner leg portions and between which the inner leg portions and the central leg portion are provided. Two coupling portions between which the inner leg portions, the central leg portion, and the outer leg portions, which are arranged in parallel, are sandwiched and with which these portions are coupled.

Advantageous Effects of the Present Disclosure

The above-mentioned reactor of the present disclosure is small in size and is less likely to be saturated with magnetism. The above-mentioned magnetic core for a reactor of the present disclosure can be used to form a reactor that is small in size and is less likely to be saturated with magnetism, and the like.

DETAILED DESCRIPTION OF PREFERRED EMBODIMENTS OF THE DISCLOSURE

Figure 1:
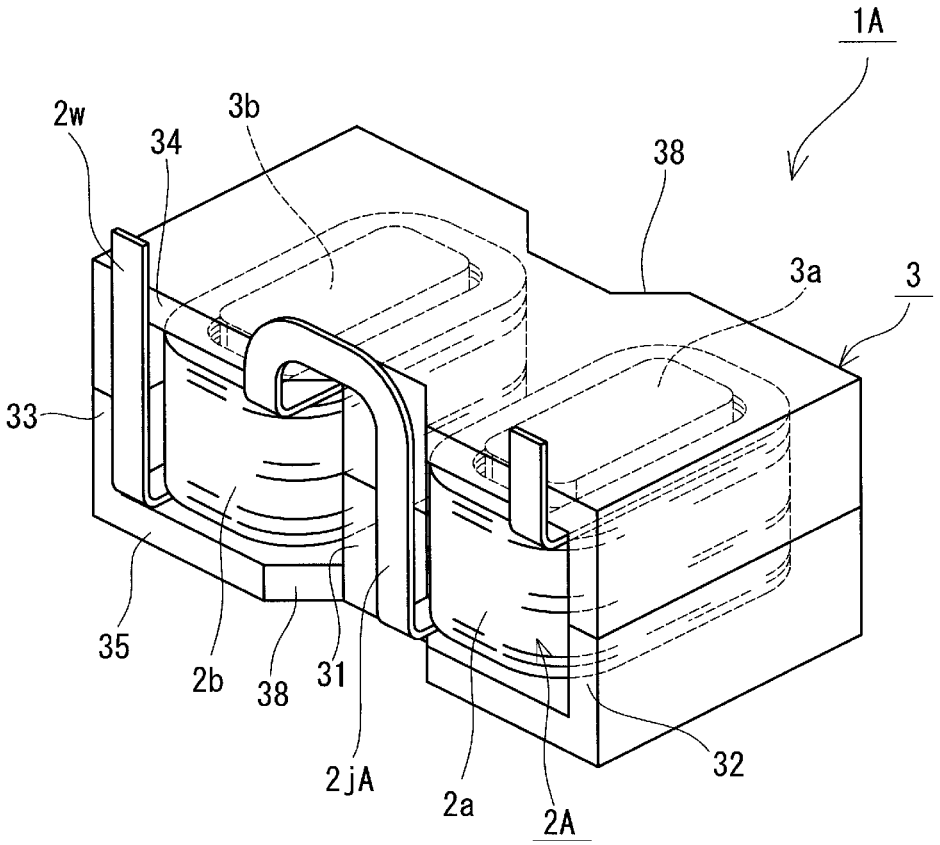
FIG. 1 is a schematic perspective view showing a reactor of Embodiment 1.

First, embodiments of the present disclosure will be listed and described.

A reactor according to an aspect of the present disclosure includes a coil including two wound portions obtained by winding a winding wire and a magnetic core in which the wound portions are arranged. The magnetic core includes an inner leg portion arranged inside inner peripheries of the wound portions; a central leg portion provided between the wound portions; two outer leg portions that are provided outside outer peripheries of the wound portions and between which the inner leg portions and the central leg portion are provided; and two coupling portions between which the inner leg portions, the central leg portion, and the outer leg portions, which are arranged in parallel, are sandwiched and with which these portions are coupled.

The above-mentioned reactor is small in size and is less likely to be saturated with magnetism. The details are as follows.

If the coil included in the above-mentioned reactor is an opposite magnetic flux coil as described below, magnetic fluxes flowing into the central leg portion from the respective wound portions can be canceled out with each other when an electric current is applied to the coil. The opposite magnetic flux coil as used herein refers to a coil in which two wound portions are provided such that magnetic fluxes passing through the respective wound portions flow in substantially opposite directions when an electric current is applied to the coil in a state in which the coil is assembled to the above-described specific magnetic core. That is, with the opposite magnetic flux coil, the two wound portions are arranged in parallel, and magnetic fluxes passing through the respective wound portions flow in opposite directions. Since the magnetic fluxes are canceled out with each other as described above, the above-mentioned reactor is less likely to be saturated with magnetism than the above-described reactor 1$\alpha$ including the O-shaped magnetic core even when a large electric current is applied. Therefore, with the above-mentioned reactor, a decrease in inductance caused by magnetic saturation is likely to be suppressed, and excellent direct-current superposition properties are realized.

If the coil included in the above-mentioned reactor is a forward magnetic flux coil as described below, the coil can be typically configured such that the number of turns in each wound portion is half the total number of turns. The forward magnetic flux coil as used herein refers to a coil in which two wound portions are provided such that magnetic fluxes passing through the respective wound portions flow in substantially the same directions when an electric current is applied to the coil in a state in which the coil is assembled to the above-described specific magnetic core. That is, with the forward magnetic flux coil, the two wound portions are arranged in parallel, and magnetic fluxes passing through the respective wound portions flow in a forward direction. The length (also referred to as "axial length" hereinafter) in the axial direction of each wound portion included in the forward magnetic flux coil is shorter than, specifically about half of, the axial length of a single wound portion in which the total number of turns is the same. The size of the magnetic core can be reduced to match such a coil with a short axial length. Therefore, the footprint is easily reduced by arranging the above-mentioned reactor in the horizontal layout, and the installation height is easily reduced by arranging the reactor in the vertical layout. Accordingly, the above-mentioned reactor is small in size. Furthermore, with the above-mentioned reactor, magnetic fluxes from the wound portions can flow into the central leg portion as well as the outer leg portions, and therefore, leakage flux can be reduced, and low loss is achieved.

In an embodiment of the above-mentioned reactor, the magnetic core includes at least one of a composite material molded article containing magnetic powder and a resin, and a powder molded article.

With the above-mentioned embodiment, an integrally molded product constituted by a composite material molded article, or an assembly of a plurality of split core pieces constituted by at least one of a composite material molded article and a powder molded article can be used as the magnetic core, and therefore, a degree of flexibility in selection of materials constituting the magnetic core is high. When the assembly is applied, the coil and the magnetic core are easily assembled together, and excellent manufacturability of the reactor is thus achieved.

In an embodiment of the above-mentioned reactor, different winding wires are used to form the wound portions, and the coil includes a connecting portion that electrically connects end portions of the winding wires.

With the above-mentioned embodiment, a coil can be manufactured by forming wound portions separately and then connecting the wound portions, and it is easy to form the wound portions. Therefore, the reactor of the above-mentioned embodiment is small in size and is less likely to be saturated with magnetism. In addition, excellent manufacturability of the coil is achieved.

In an embodiment of the above-mentioned reactor, the wound portions are connected such that magnetic fluxes passing through the wound portions flow in the same direction.

With the above-mentioned embodiment, the above-described forward magnetic flux coil is included. Therefore, the reactor is small in size as the installation height can be reduced by arranging the reactor in the vertical layout, for example. In addition, low loss is achieved.

In an embodiment of the above-mentioned reactor, the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

With the above-mentioned embodiment, the coil and the magnetic core are easily assembled together, and the number of components to be assembled is small. Therefore, the reactor of the above-mentioned embodiment is small in size and is less likely to be saturated with magnetism. In addition, excellent manufacturability of the reactor is achieved.

A magnetic core for a reactor of the present disclosure is a magnetic core for a reactor to which a coil including two wound portions obtained by winding a winding wire is assembled, and the magnetic core includes an inner leg portion arranged inside inner peripheries of the wound portions. A central leg portion is arranged apart from the inner leg portions and is provided between the inner leg portions. Two outer leg portions are arranged apart from the inner leg portions and between which the inner leg portions and the central leg portion are provided. Two coupling portions between which the inner leg portions, the central leg portion, and the outer leg portions, which are arranged in parallel, are sandwiched and with which these portions are coupled.

With the above-mentioned magnetic core for a reactor, a reactor that is small in size and is less likely to be saturated with magnetism can be formed. The following are the details.

When the above-described opposite magnetic flux coil is used as a coil to be assembled to the above-mentioned magnetic core for a reactor, magnetic fluxes from the respective wound portions can be canceled out with each other in the central leg portion. Therefore, a reactor including the above-mentioned magnetic core for a reactor is less likely to be saturated with magnetism than the above-described reactor 1*a* including the O-shaped magnetic core even when a large electric current is applied. Therefore, with the above-mentioned magnetic core for a reactor, a decrease in inductance caused by magnetic saturation is likely to be suppressed, and a reactor with excellent direct-current superposition properties can be formed.

When the above-described forward magnetic flux coil is used as a coil to be assembled to the above-mentioned magnetic core for a reactor, the inner leg portions can be shortened in response to the axial lengths of the wound portions being relatively short as described above. The central leg portion and the outer leg portions can be shortened to match the inner leg portions. The footprint is easily reduced by applying the above-mentioned magnetic core for a reactor with such a configuration to a reactor to be arranged in the horizontal layout, and the installation height is easily reduced by applying the magnetic core for a reactor to a reactor to be arranged in the vertical layout. Therefore, with the above-mentioned magnetic core for a reactor, a small reactor can be formed. Furthermore, with the above-mentioned magnetic core for a reactor, leakage flux can be reduced due to the central leg portion, thus making it possible to form a low-loss reactor.

Hereinafter, embodiments of the present disclosure will be specifically described with reference to the drawings. In the figures, components having the same name are denoted by the same reference numeral. In the following description, the lower surface of each of reactors shown in the diagrams is used as an installation surface to be arranged on a placement surface of an installation target. In the reactors shown in the diagrams, a direction in which leg portions included in a magnetic core are lined up (e.g., left-right direction in FIGS. 2 and 3) is also referred to as a "width direction", the axial direction of the leg portions (e.g., vertical direction in FIG. 3) is also referred to as a "height direction", and a direction that is orthogonal to both the width direction and the height direction (e.g., vertical direction in FIG. 2) is also referred to as a "longitudinal direction".

Embodiment 1

Figure 2:
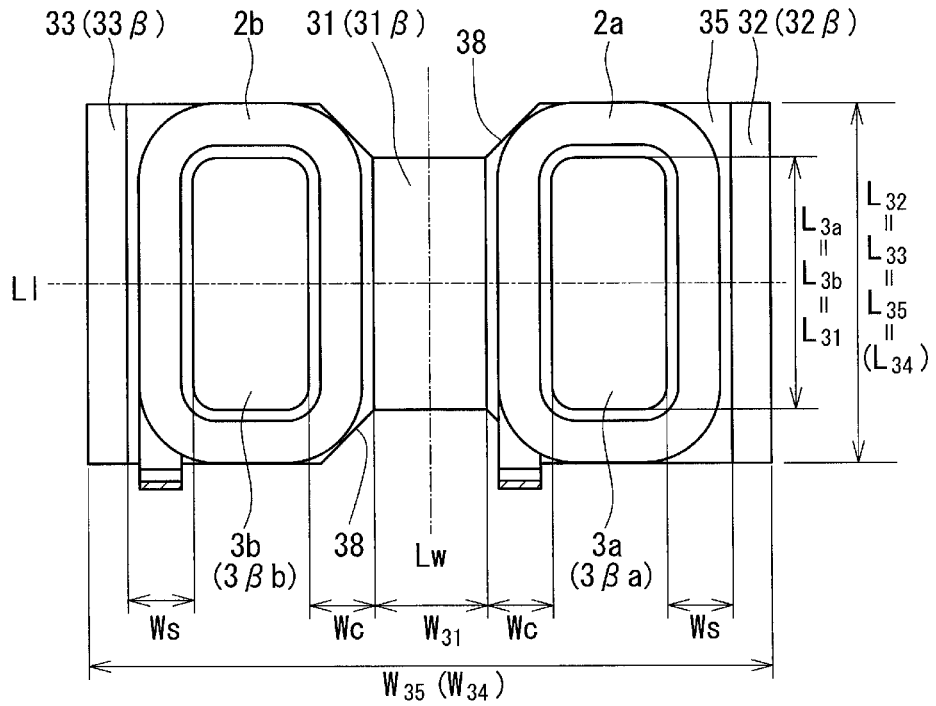
FIG. 2 is a plan view of a coil and a split core piece included in the reactor of Embodiment 1 as viewed in the axial direction of wound portions.
Figure 3:
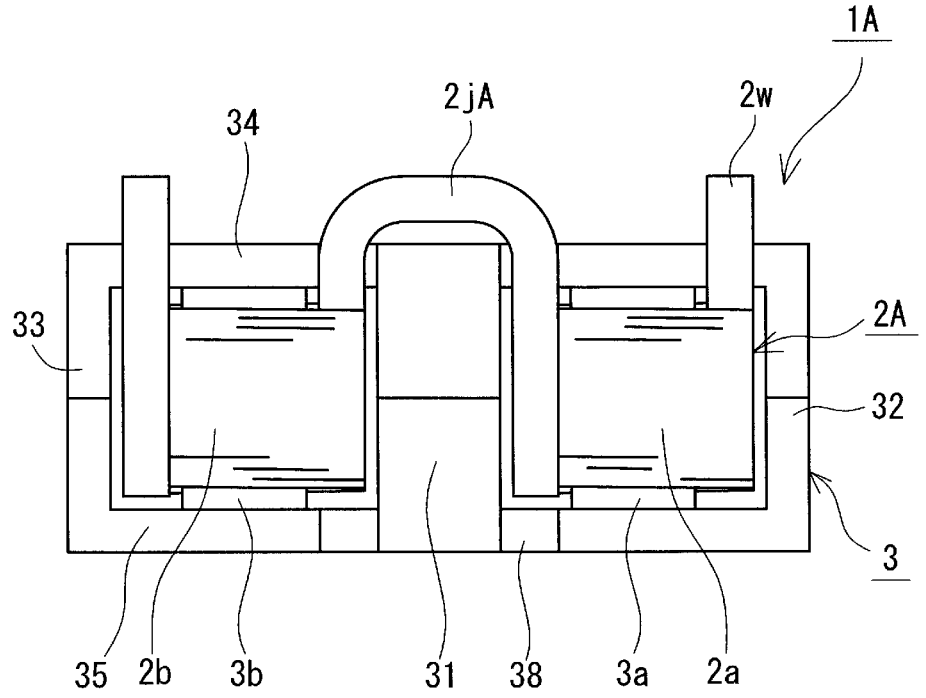
FIG. 3 is a front view showing the reactor of Embodiment 1.

A reactor 1A of Embodiment 1 and a magnetic core 3 of an embodiment will be described with reference to FIGS. 1 to 4. FIG. 2 shows a state in which a coil 2A shown in FIG. 1 is cut along a plane that is orthogonal to the axial direction of wound portions 2*a* and 2*b*. FIG. 3 is a front view of the reactor 1A shown in FIG. 1 showing a side on which a connecting portion 2*j*A of a coil 2A is arranged, as viewed in a direction (left-right direction in FIG. 3) that is orthogonal to the direction in which the wound portions 2*a* and 2*b* are lined up.

Reactor

Outline

Figure 4:
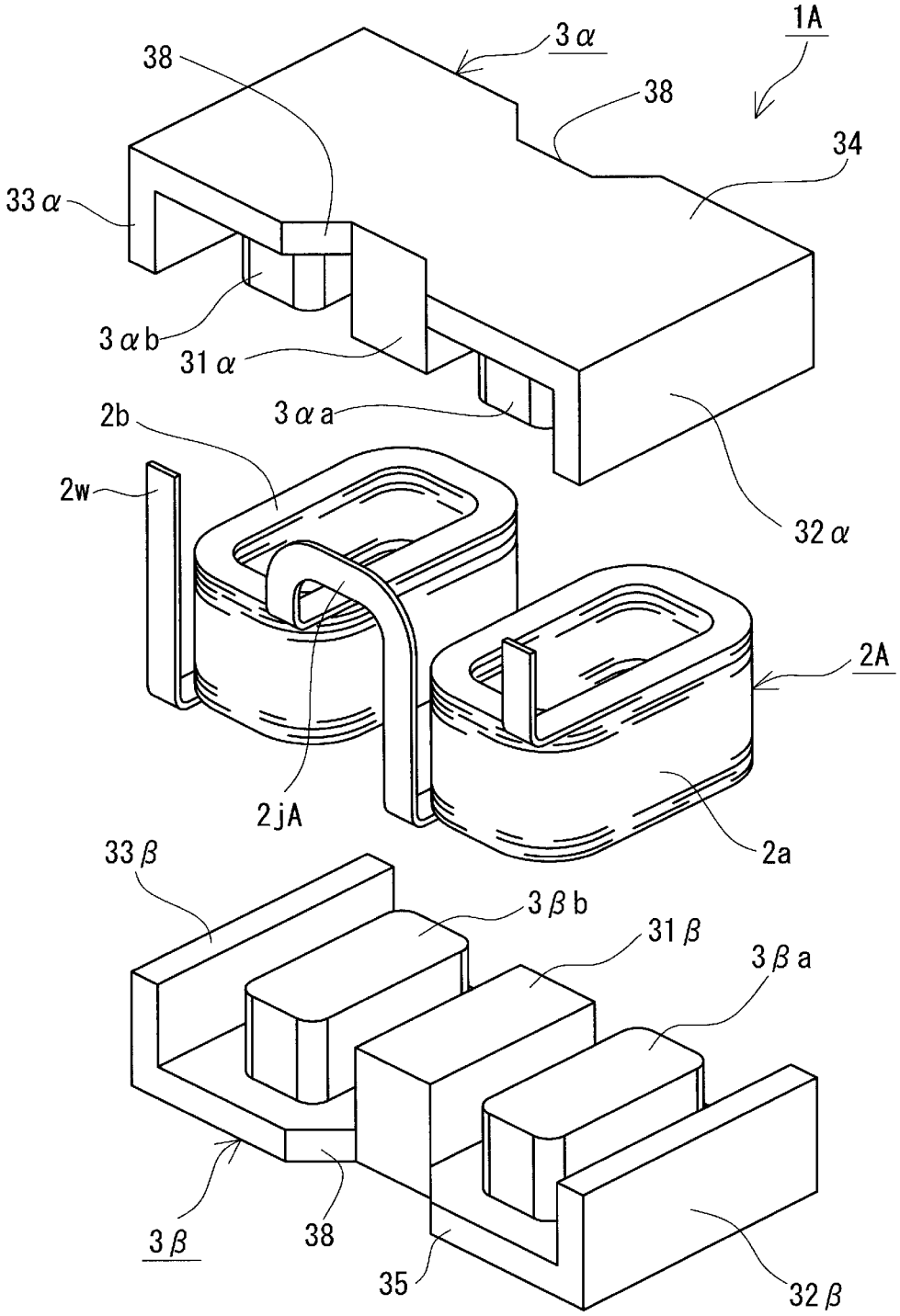
FIG. 4 is a schematic exploded perspective view showing the reactor of Embodiment 1.

As shown in FIG. 1, the reactor 1A of Embodiment 1 includes a coil 2A including two wound portions 2*a* and 2*b* obtained by winding a winding wire 2*w*, and a magnetic core 3 in which the wound portions 2*a* and 2*b* are arranged. The magnetic core 3 of the embodiment has a specific shape. In short, the magnetic core 3 has a shape obtained by further providing the above-described EE core with two magnetic legs that are provided on two sides of the middle leg such that the middle leg is provided therebetween. The magnetic core 3 includes five magnetic legs (inner leg portions 3*a* and 3*b*, a central leg portion 31, and outer leg portions 32 and 33; see FIG. 2 as well) that are arranged in parallel with intervals therebetween, and two coupling portions 34 and 35 that sandwich and couple the magnetic legs. The magnetic core 3 of this embodiment is an assembly of a plurality of split core pieces 3α and 3β (FIG. 4). The reactor 1A of this embodiment is used in the vertical layout where the reactor 1A is installed such that the axial direction of the wound portions 2*a* and 2*b* (or the axial direction of the inner leg portions 3*a* and 3*b*) is orthogonal to the placement surface of an installation target (not shown) such as a converter case. The reactor 1A of this embodiment includes, as the coil 2A, the above-described forward magnetic flux coil in which the wound portions 2*a* and 2*b* are connected such that the magnetic fluxes passing through the respective wound portions 2*a* and 2*b* flow in the same direction. Hereinafter, constituent elements will be described in detail.

Coil

Outline

As shown in FIG. 4, the coil 2A includes tubular wound portions 2*a* and 2*b* obtained by spirally winding a single winding wire 2*w*, and a connecting portion 2*j*A that is constituted by a portion of the winding wire 2*w* located between the wound portions 2*a* and 2*b* and electrically connects the wound portions 2*a* and 2*b*. The wound portions 2*a* and 2*b* are arranged side-by-side with a predetermined interval (here, the interval is greater than or equal to a width $W_{31}$ of the central leg portion 31 (FIG. 2)) such that their axes extend in parallel.

Winding Wire

The winding wire 2*w* of this embodiment is a coated wire including a conductive wire made of copper or the like, and an insulating coating that is made of an insulating material such as polyamideimide and covers the outer periphery of the conductive wire. The winding wire 2*w* is a flat wire with a rectangular cross section. The wound portions 2*a* and 2*b* of this embodiment are edgewise coils. Wire rods with various shapes such as a round wire can also be used as the winding wire 2*w*. Compared with a case where a round wire is used, using a flat wire to form edgewise coils as in this embodiment makes it easier to increasing a space factor and thus reduce the size (in particular, the axial length is easily reduced), and is advantageous in that (1) the installation height of the coil 2 is easily reduced by reducing the thickness of the winding wire 2*w* and (2) the end surfaces of the coil 2A (upper surface and lower surface in FIG. 4) is easily made substantially flat, in the case of the vertical layout.

Wound Portion

The wound portions 2*a* and 2*b* of this embodiment have the same shape, and are formed in a quadrilateral tube shape in which the end surfaces have a rectangular shape with round corners. The shape of the wound portions 2*a* and 2*b* can be selected as appropriate, and an example thereof is a cylindrical shape. Moreover, the wound portions 2*a* and 2*b* of this embodiment are configured such that the winding directions and the numbers of turns are the same, and are connected to each other via the connecting portion 2*j*A such that magnetic fluxes passing through the respective wound portions 2*a* and 2*b* flow in the same direction when an electric current is applied to the coil 2A. Such a coil 2A can be considered to include two wound portions 2*a* and 2*b* obtained by dividing one wound portion in which the total number of turns is the same, and the axial length of the coil 2A is smaller than that of a coil (referred to as a "single coil" hereinafter) including a single wound portion in which the total number of turns is the same. Therefore, when the reactor 1A is vertically installed, the installation height is lower compared with a case of using the reactor including the single coil. It should be noted that the winding directions and the numbers of turns in the wound portions 2*a* and 2*b* can be selected as appropriate. Winding the wire in the same direction as in this embodiment makes it easy to form the wound portions 2*a* and 2*b*, and excellent manufacturability of the coil 2A is thus achieved. Setting the numbers of turns to be the same as in this embodiment makes it possible to make the axial length of the coil 2A the shortest, thus making it possible to reduce the installation height of the reactor 1A arranged in the vertical layout.

Connecting Portion

The connecting portion 2*j*A of this embodiment is formed by bending the winding wire 2*w*, which is a single continuous wire forming the wound portions 2*a* and 2*b*, as appropriate at a portion located between the wound portions 2*a* and 2*b*. The connecting portion 2*j*A as used herein has a portion bent into a reverse J-shape (including two flatwise bent portions and two edgewise bent portions) so as to connect the lower end surface of one of the wound portions, namely the wound portion 2*a*, and the upper end surface of the other of the wound portions, namely the wound portion 2*b*. Moreover, the connecting portion 2*j*A as used herein has a size with which a portion thereof protrudes from a surface (here, the upper surface of a coupling portion 34 located on the upper side) that is on a side opposite to the installation surface of the magnetic core 3 (here, the lower surface of a coupling portion 35 located on the lower side) when the reactor 1A is vertically installed as shown in FIG. 3. The shape and size of the connecting portion 2*j*A can be selected as appropriate (see Embodiments 2 and 3, which will be described later). It is preferable that the size of the connecting portion 2*j*A in the height direction is adjusted in accordance with the axial lengths of the wound portions 2*a* and 2*b*, for example, and the size of the connecting portion 2*j*A in the width direction is adjusted in accordance with the width $W_{31}$ of the central leg portion 31, for example. Allowing a portion of the connecting portion 2*j*A to protrude from the magnetic core 3 as in this embodiment makes it easy to form the coil 2A, and excellent manufacturability is thus achieved. The installation height of the reactor 1A arranged in the vertical layout can be further reduced by bending the connecting portion 2*j*A such that this protruding portion overlaps the upper surface of the coupling portion 34 after the coil 2A and the magnetic core 3 are assembled together.

End Portions

The end portions of the winding wire 2*w* that are continuous with the wound portions 2*a* and 2*b* are used as portions to be connected to external devices such as a power source. Here, the case where the end portions of the winding wire 2*w* are guided upward so as to move away from the wound portions 2*a* and 2*b*, and are arranged adjacent to the connecting portion 2*j*A is shown as an example, but the guiding direction, guiding length, and the like can be changed as appropriate.

Other Configurations

The coil 2A can include a resin molded portion (not shown) that covers at least a portion of the outer peripheries of the wound portions 2*a* and 2*b*. The resin molded portion can be configured to cover the substantial entirety of the inside and outside of the wound portions 2*a* and 2*b*, or cover the wound portions 2*a* and 2*b* while at least a portion of the inner peripheral surfaces, outer peripheral surfaces, and end surfaces of the wound portions 2*a* and 2*b* is not covered and is exposed, for example. When an exposed portion (which will be described later) of the wound portions 2*a* and 2*b* that is not covered with the magnetic core 3 is also exposed from the resin molded portion, it is easy to enhance heat dissipation properties. Arranging the resin molded portion between the wound portions 2*a* and 2*b* and the magnetic core 3 makes it possible to enhance electric insulation between the coil 2A and the magnetic core 3. It should be noted that, when the resin molded portion is not provided, using the above-described coated wire as the winding wire 2*w* makes it possible to enhance electric insulation between the coil 2A and the magnetic core 3.

Examples of the constituent material of the resin molded portion include insulating resins such as thermoplastic resins and thermosetting resins. Examples of the thermoplastic resins include polyphenylene sulfide (PPS) resin, polytetrafluoroethylene (PTFE) resin, a liquid crystal polymer (LCP), polyamide (PA) resin (such as nylon 6 or nylon 66), polybutylene terephthalate (PBT) resin, and acrylonitrile-butadiene-styrene (ABS) resin. Examples of the thermosetting resins include unsaturated polyester resin, epoxy resin, urethane resin, and silicone resin. Nonmagnetic nonmetallic powder made of alumina, silica, or the like can be added to the insulating resin. In this case, heat dissipation properties, electric insulation, and the like can be enhanced.

Magnetic Core

Outline

The magnetic core 3 of this embodiment is used in the reactor 1A in which the coil 2A including the two wound portions 2*a* and 2*b* obtained by winding the winding wire 2*w* is provided. This magnetic core 3 includes the inner leg portions 3*a* and 3*b* that are respectively arranged inside the inner peripheries of the wound portions 2*a* and 2*b*, the central leg portion 31 that is arranged between the wound portions 2*a* and 2*b*, the two outer leg portions 32 and 33 between which the two inner leg portions 3*a* and 3*b* and the central leg portion 31 are provided, and the two coupling portions 34 and 35 between which the two inner leg portions 3*a* and 3*b*, the central leg portion 31, and the two outer leg portions 32 and 33, which are arranged in parallel, are sandwiched and with which these portions are coupled. The central leg portion 31 is arranged apart from the inner leg portions 3*a* and 3*b*. The outer leg portions 32 and 33 are arranged apart from the inner leg portions 3*a* and 3*b*, respectively (FIGS. 2 and 4). The gaps between the portions formed by arranging these portions as described above are used as portions at which the wound portions 2*a* and 2*b* are to be arranged. Specifically, as shown in FIG. 2, one of the wound portions, namely the wound portion 2*a*, is arranged to be fit in a gap (width Wc) between the central leg portion 31 and one of the inner leg portions, namely the inner leg portion 3*a*, and a gap (width Ws) between one of the inner leg portions, namely the inner leg portion 3*a*, and one of the outer leg portions, namely the outer leg portion 32. The other of the wound portions, namely the wound portion 2*b*, is arranged to be fit in a gap (width Wc) between the central leg portion 31 and the other of the inner leg portions, namely the inner leg portion 3*b*, and a gap (width Ws) between the other of the inner leg portions, namely the inner leg portion 3*b*, and the other of the outer leg portions, namely the outer leg portion 33. The outer leg portions 32 and 33 are respectively provided outside the outer peripheries of the wound portions 2*a* and 2*b* such that the group of the leg portions including the inner leg portion 3*a*, the central leg portion 31, and the inner leg portion 3*b*, which are lined up in this order from the outer leg portion 32 side to the outer leg portion 33 side, is provided therebetween.

Constituent Material

The magnetic core 3 can be formed of a composite material molded article containing magnetic powder and a resin. Examples of particles of the magnetic powder include particles made of a soft magnetic metal or a soft magnetic nonmetal, and coated particles obtained by providing an insulating coating made of a phosphate or the like on the outer peripheries of the particles made of a soft magnetic metal. Examples of the soft magnetic metal include iron group metals such as pure iron and iron alloys (e.g., Fe—Si alloy and Fe—Ni alloy). An example of the soft magnetic nonmetal is ferrite.

For example, the content of the magnetic powder in the composite material is 30 vol % or more and 80 vol % or less, and the content of the resin is 10 vol % or more and 70 vol % or less. The content of the magnetic powder can be set to 50 vol % or more, 55 vol % or more, or 60 vol % or more, from the viewpoint of enhancing saturation magnetic flux density and heat dissipation properties. The content of the magnetic powder can be set to 75 vol % or less, or 70 vol % or less, from the viewpoint of enhancing the fluidity during the manufacturing process.

Examples of the resin contained in the composite material include thermosetting resins and thermoplastic resins, which were described in the above-described section of "Resin molded portion", as well as cold setting resins and low-temperature curing resins. Bulk molding compounds (BMCs) obtained by mixing calcium carbonate or glass fibers to unsaturated polyester, millable-type silicone rubber, millable-type urethane rubber, and the like can also be used.

The composite material may also contain nonmagnetic nonmetallic powder made of alumina, silica, or the like in addition to the magnetic powder and the resin. The content of the nonmagnetic nonmetallic powder may be 0.2 mass % or more and 20 mass % or less, 0.3 mass % or more and 15 mass % or less, and 0.5 mass % or more and 10 mass % or less.

The composite material molded article can be manufactured using an appropriate molding method such as injection molding or a cast molding. For example, an integrally molded magnetic core 3 can be manufactured by placing the coil 2A in a mold having an appropriate shape and fill the inside and the outside of the coil 2A with a fluidized composite material. Using a mold having an appropriate shape makes it possible to manufacture a split core piece formed of a composite material molded article. The composite material molded article can also be easily molded into a complex shape, and thus excellent manufacturability is achieved.

Alternatively, the magnetic core 3 can be formed of a powder molded article containing magnetic powder. Typical examples of the powder molded article include those obtained by molding mixed powder containing magnetic powder and a binder into a predetermined shape through compression molding, and those obtained by being further subject to heat treatment after being molded. A resin can be used as the binder, and the content thereof may be about 30 vol % or less. The binder may be decomposed or be thermally denatured through heat treatment. Using a mold having an appropriate shape makes it possible to manufacture a split core piece formed of the powder molded article. With the powder molded article, the content of the magnetic powder can be increased compared with a case where the composite material molded article is used, and thus a magnetic core having a high saturation magnetic flux density is easily formed.

Alternatively, the magnetic core 3 can be formed of a laminate obtained by laminating soft magnetic plates such as silicon steel plates, or a sintered body such as a ferrite core.

The magnetic core 3 can be provided with a gap material or an air gap. Examples of the gap material include materials made of a nonmagnetic material such as alumina, and materials that are made of a mixture of a magnetic material and a nonmagnetic material and have a low relative permeability than molded articles such as split core pieces. When the magnetic core 3 includes the composite material molded article or the like and is less likely to be saturated with magnetism, a magnetic gap such as a gap material and an air gap can be omitted or reduced. In this case, loss caused by leakage flux at the magnetic gap portion is easily reduced, and the coil 2A and the magnetic core 3 can be arranged in proximity to each other. Therefore, the size is easily reduced.

Molded State

An integrally molded product can be used for the magnetic core 3. In this case, as described above, the magnetic core 3 formed of a composite material molded article can be easily manufactured. Also, in this case, if the coil 2A includes a resin molded portion or the like, the shape of the coil 2A is easily maintained. FIG. 2 is similar to the lateral cross section obtained by cutting the magnetic core 3, which is formed of an integrally molded product, along a plane that is orthogonal to the axial direction of the group of the leg portions including the central leg portion 31 and the like.

Alternatively, when an assembly of a plurality of split core pieces is used as the magnetic core 3 as in this embodiment, the magnetic core 3 and the coil 2A are easily assembled together, and thus excellent manufacturability of the reactor 1A is achieved. The number of division, the shapes of the split core pieces, the constituent material, and the like can be selected as appropriate. As shown in FIG. 4, the magnetic core 3 of this embodiment is formed by attaching a pair of split core pieces 3*a* and 3*b*. One of the split core pieces, namely the split core piece 3*a*, includes one of the coupling portions, namely the coupling portion 34, two inner leg pieces 3α*a* and 3α*b* that rise from the coupling portion 34 and form portions of the inner leg portions 3*a* and 3*b*, a central leg piece 31α that forms a portion of the central leg portion 31, and two outer leg pieces 32α and 33α that form portions of the outer leg portions 32 and 33. The other of the split core pieces, namely the split core piece 36, includes the other of the coupling portions, namely the coupling portion 35, two inner leg pieces 3β*a* and 3β*b* that rise from the coupling portion 35 and form the other portions of the inner leg portions 3*a* and 3*b*, a central leg piece 31β that forms the other portion of the central leg portion 31, and two outer leg pieces 32β and 33β that form the other portions of the outer leg portions 32 and 33. In this embodiment, each of the shapes of the end surfaces of the split core pieces 3α and 3β is symmetrical about a central line Lw in the width direction and a central line L1 in the longitudinal direction as shown in FIG. 2 (the same applies to the shapes of the lateral cross sections). When the split core pieces 3α and 3β are formed to have the same shape, the same size, and a symmetrical shape as described above, excellent manufacturability of the split core pieces is achieved. When an assembly of the pair of split core pieces 3α and 3β is used as the magnetic core 3 as in this embodiment, the number of assembling steps can be reduced, and thus excellent workability for assembly of the reactor 1A is achieved. The magnetic core 3 may have a configuration in which the split core pieces are made of different materials (e.g., a configuration in which a split core piece formed of a composite material molded article and a split core piece formed of a powder molded article are included) or a configuration in which all the split core pieces are made of the same material.

Central Leg Portion, Inner Leg Portions, Outer Leg Portions, Coupling Portions

The inner leg portions 3*a* and 3*b* of this embodiment have the same shape and size as shown in FIGS. 1, 2, and 4. Also, the inner leg portions 3*a* and 3*b* of this embodiment have a rectangular parallelepiped shape in which the shape of the lateral cross section (which is equal to the shapes of the end surfaces of the inner leg pieces 3α*a*, 3α*b*, 3β*a*, and 3β*b*) taken along a plane orthogonal to the axial direction of the inner leg portions 3*a* and 3*b* (which typically extends in substantially the same direction as the axial direction of the wound portions 2*a* and 2*b*) corresponds to the inner peripheral shapes of the wound portions 2*a* and 2*b*. The shapes and sizes of the inner leg portions 3*a* and 3*b* can be selected as appropriate depending on the shapes and sizes of the wound portions 2*a* and 2*b* as long as the lateral cross sections have a predetermined area for a magnetic path. When the outer peripheral shapes of the inner leg portions 3*a* and 3*b* are similar to the inner peripheral shapes of the wound portions 2*a* and 2*b* as in this embodiment, it is easy to bring the magnetic core 3 and the coil 2A close to each other and assemble them together, thus making it possible to reduce the size.

The central leg portion 31 of this embodiment has a rectangular parallelepiped shape as shown in FIGS. 2 to 4, and the shape of the lateral cross section (which is equal to the shapes of the end surfaces of the central leg pieces 31α and 31β) taken along a plane orthogonal to the axial direction of the central leg portion 31 (which typically extends substantially in parallel with the axial direction of the wound portions 2*a* and 2*b*) has a rectangular shape. The size (e.g., lateral cross-sectional area) of the central leg portion 31 is adjusted so as to have a predetermined cross-sectional area for a magnetic path. When the cross-sectional area for a magnetic path of the central leg portion 31 is 50% or more, 60% or more, or 70% or more of the lateral cross-sectional area of one inner leg portion (3*a* or 3*b*), it is expected that the central leg portion 31 can function as a magnetic path. In this embodiment, the lateral cross-sectional area of the central leg portion 31 is substantially the same as the cross-sectional area of one inner leg portion (3*a* or 3*b*). The central leg portion 31 has a width $W_{31}$ and a length $L_{31}$ that are substantially the same as widths and the lengths $L_{3a}$ and $L_{3b}$ of the inner leg portions 3*a* and 3*b*, respectively.

The outer leg portions 32 and 33 of this embodiment have the same shape and size as shown in FIGS. 2 to 4. Moreover, in the outer leg portions 32 and 33 of this embodiment, the shape of the lateral cross section (which is equal to the shapes of the end surfaces of the outer leg pieces 32α, 32β, 33α, and 33β) taken along a plane orthogonal to the axial direction of the outer leg portions 32 and 33 (which typically extends substantially in parallel with the axial direction of the wound portions 2*a* and 2*b*) has a rectangular shape. The shapes and sizes of the outer leg portions 32 and 33 can be selected as appropriate depending on the shapes and sizes of the wound portions 2*a* and 2*b* as long as the lateral cross sections have a predetermined area for a magnetic path. In this embodiment, the respective areas of the lateral cross sections of the outer leg portions 32 and 33 are substantially the same as half of the area of the cross section of one inner leg portion (3*a* or 3*b*). Moreover, in this embodiment, the respective widths of the outer leg portions 32 and 33 are smaller than the width of one inner leg portion, and lengths $L_{32}$ and $L_{33}$ of the outer leg portions 32 and 33 are longer than the lengths $L_{3a}$ and $L_{3b}$ of the inner leg portions 3*a* and 3*b*. Therefore, the two sides in the longitudinal direction of the outer leg portions 32 and 33 protrude from the group of the leg portions including the inner leg portions 3*a* and 3*b* and the central leg portion 31.

The coupling portions 34 and 35 of this embodiment are formed in a thin rectangular parallelepiped shape and have the same shape and size. One surface of the coupling portions 34 and 35 (the lower surface of the coupling portion 35 in FIGS. 1 and 3) serves as an installation surface to be arranged on the placement surface of an installation target. The coupling portions 34 and 35 have widths $W_{34}$ and $W_{35}$ and lengths $L_{34}$ and $L_{35}$ with which the group of leg portions, namely the outer leg portion 32, the inner leg portion 3*a*, the central leg portion 31, the inner leg portion 3*b*, and the outer leg portion 33, which are arranged side-by-side with intervals, can be provided therebetween. In this embodiment, as shown in FIGS. 2 and 4, the central leg portion 31 is provided at the central portions in the width direction and the longitudinal direction of the coupling portions 34 and 35, and a set of the inner leg portion 3*a* and the outer leg portion 32, and a set of the inner leg portion 3*b* and the outer leg portion 33 are respectively provided on the two sides of the central leg portion 31. Moreover, in this embodiment, cutout portions 38 formed by cutting out trapezoidal portions are provided at the central portion in the width direction, and the lengths vary depending on the portions. In the coupling portions 34 and 35, the two edges in the width direction correspond to the edges of the lateral surfaces of the outer leg portions 32 and 33 that are provided on the two sides in the width direction, and the lengths $L_{34}$ and $L_{35}$ of portions provided on the two sides in the width direction of the respective coupling portions 34 and 35 are equal to the lengths $L_{32}$ and $L_{33}$ of the outer leg portions 32 and 33. On the other hand, the lengths of the central portions in the width direction of the coupling portions 34 and 35, namely the lengths of the regions provided with the central leg portion 31, are equal to the lengths $L_3$, and Lab of the inner leg portions 3*a* and 3*b* due to the above-described cutout portions 38 being formed. In the coupling portions 34 and 35, the regions provided on the two sides in the length direction of the inner leg portions 3*a* and 3*b* are used as the portions on which the wound portions 2*a* and 2*b* are arranged (FIG. 2). The total length of each region corresponds to a difference between the length $L_{34}$ or $L_{35}$ and the length $L_{3a}$ or $L_{3b}$, which are described above.

As shown in FIG. 2, in this magnetic core 3 of this embodiment, linear gaps are provided between the inner leg portion 3*a* and the central leg portion 31, between the inner leg portion 3*b* and the central leg portion 31, between the inner leg portion 3*a* and the outer leg portions 32, which are adjacent to each other, and between the inner leg portion 3*b* and the outer leg portions 33, which are adjacent to each other. The widths $W_{34}$ and $W_{35}$ of the coupling portions 34 and 35 are adjusted such that widths Wc and Ws of these gaps are slightly larger than the widths of the wound portions 2*a* and 2*b*. This makes it possible to enhance insulation between the coil 2A and the magnetic core 3, and also makes it easy to assemble the coil 2A and the split core pieces 3α and 3β together.

In the magnetic core 3 of this embodiment, the lengths $L_{34}$ and $L_{35}$ of the coupling portions 34 and 35 are adjusted such that when the coil 2A is assembled to the magnetic core 3, surfaces (upper and lower surfaces in FIG. 2) arranged on the two sides in the longitudinal direction out of the outer peripheral surfaces of the wound portions 2*a* and 2*b* are not covered with the magnetic core 3 and exposed (FIGS. 1 and 3), and the other regions are substantially covered with the magnetic core 3. Here, the lengths $L_{34}$ and $L_{35}$ and the lengths $L_{3a}$, $L_{3b}$, and $L_{31}$ are adjusted such that the portions of the wound portions 2*a* and 2*b* exposed from the magnetic core 3 are substantially flush with the end surfaces (upper and lower surfaces in FIG. 2) arranged on the two sides in the longitudinal direction of the coupling portions 34 and 35. The exposed portions of the wound portions 2*a* and 2*b* can be used as heat dissipation surfaces while the reactor 1A is being used, for example.

Application

The reactor 1A of Embodiment 1 can be used in constituent components of various types of converters such as vehicle-mounted converters (typically DC-DC converters) to be mounted in vehicles including hybrid cars, plug-in hybrid cars, electric cars, fuel cell cars, and the like, and converters for an air conditioner, and constituent components of power conversion devices. In particular, the reactor 1A of Embodiment 1 can be used in cases where large inductance is required, the number of turns is relatively large, and a low height is in demand. The magnetic core 3 of this embodiment can be used as a constituent element of the reactor 1A or the like.

Main Effects

With the reactor 1A of Embodiment 1, even when the total number of turns in the coil 2A is relatively large, a forward magnetic flux coil including separate wound portions 2*a* and 2*b* is used, thus making it possible to make the axial length of the coil 2A shorter than that of a single coil in which the total number of turns is the same. Arranging, in the vertical layout, the reactor 1A including such a forward magnetic flux coil and the magnetic core 3 having a specific shape makes it possible to reduce the installation height. From this viewpoint, the reactor 1A of Embodiment 1 is small in size. If the amount of protrusion of the connecting portion 2*j*A of the coil 2A from the magnetic core 3 is further reduced by bending the connecting portion 2*j*A as described above, for example, the installation height of the reactor 1A can be further reduced. The magnetic core 3 for a reactor of this embodiment contributes to a reduction in height when used in the reactor 1A, which includes the above-mentioned forward magnetic flux coil and is arranged in the vertical layout, for example.

Since the reactor 1A of Embodiment 1 includes the magnetic core 3 including the central leg portion 31 in addition to the inner leg portions 3*a* and 3*b* and the outer leg portions 32 and 33, magnetic fluxes from the wound portions 2*a* and 2*b* are less likely to leak to the outside of the magnetic core 3. Therefore, the reactor 1A of Embodiment 1 is a low-loss reactor. The magnetic core 3 for a reactor of this embodiment can reduce leakage flux and contributes to a reduction in loss when used in the reactor 1A including the above-mentioned forward magnetic flux coil.

In addition, with the reactor 1A of this embodiment, the following effects are exhibited.

The outer peripheral surfaces of the wound portions 2*a* and 2*b* are partially flush with the outer surface of the magnetic core 3, and the number of portions of the coil 2A that protrude from the magnetic core 3 is small. Here, the above-mentioned protruding portions are substantially only the two end portions of the winding wire 2*w* and a portion of the connecting portion 2*j*A, and the footprint of the reactor 1A is substantially equal to the area of the installation surface (the lower surface of the coupling portion 35) of the magnetic core 3. The reactor 1A is small in size since the footprint is small.

Since portions of the wound portions 2*a* and 2*b* are not covered with the magnetic core 3 and are exposed, heat dissipation properties can be enhanced.

The magnetic core 3 includes portions at which the wound portions 2*a* and 2*b* are arranged, and thus positioning of the coil 2A and the magnetic core 3 can be easily performed. In addition, an assembly of the pair of split core pieces 3α and 3β is used as the magnetic core 3, the coil 2A and the magnetic core 3 can be easily assembled together. Therefore, excellent manufacturability of the reactor 1A is achieved.

Since the magnetic core 3 is constituted by the assembly of the split core pieces 3α and 3β having the same shape, and the shape of the split core pieces 3α and 3β is symmetrical and simple, excellent manufacturability of the magnetic core 3 is achieved.

Since the magnetic core 3 is provided with the cutout portions 38, the weight of the magnetic core 3 can be reduced, and thus the weight of the reactor 1A can be reduced. It should be noted that the cutout portions 38 are formed at positions through which magnetic fluxes from the wound portions 2*a* and 2*b* barely pass, thus making it possible to ensure a predetermined area for a magnetic path even when portions of the magnetic core 3 are removed.

Hereinafter, other examples of the connecting portions 2*j*A of the coil 2A will be described with reference to FIGS. 5 and 6.

Figure 5:
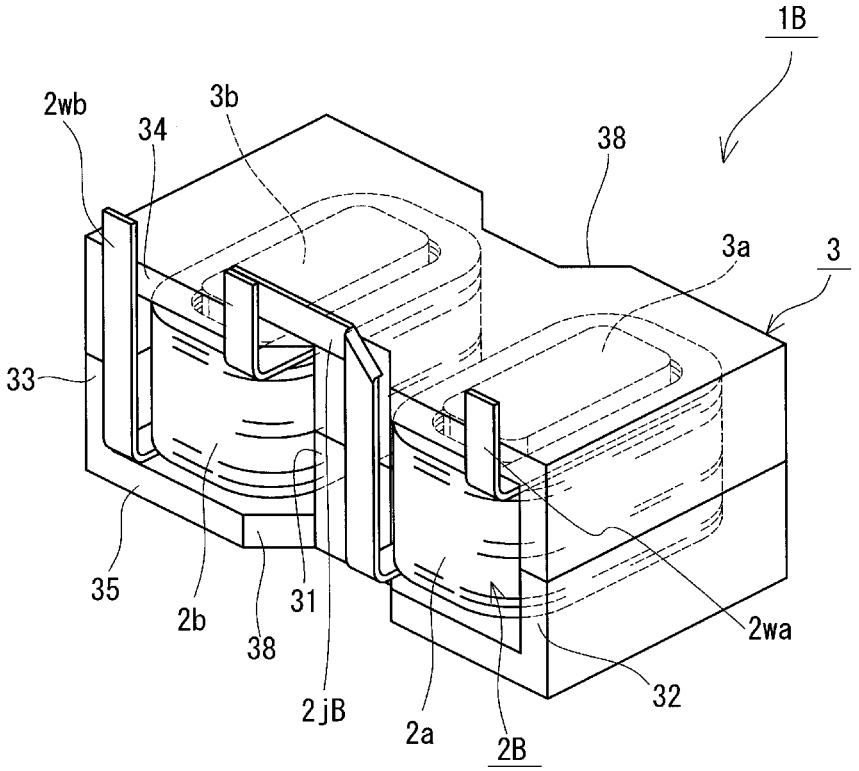
FIG. 5 is a schematic perspective view showing a reactor of Embodiment 2.
Figure 6:
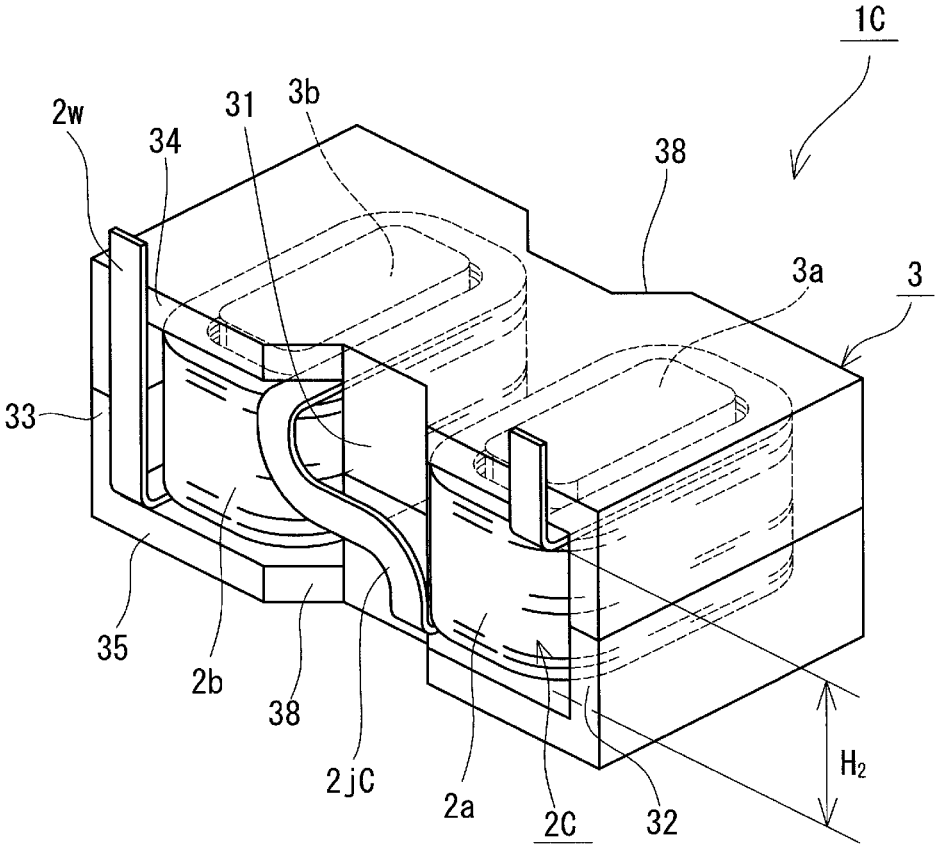
FIG. 6 is a schematic perspective view showing a reactor of Embodiment 3.

The basic configurations of a reactor 1B of Embodiment 2 shown in FIG. 5 and a rector 1C of Embodiment 3 shown in FIG. 6 are the same as that of the above-described rector 1A of Embodiment 1. The structures of connecting portions 2*j*B and 2*j*C of coils 2B and 2C provided in the reactor 1B and 1C are different from that of the connecting portions 2*j*A.

Hereinafter, the connecting portions 2*j*B and 2*j*C will be described in detail, and specific description of the other configurations and the effects thereof will be omitted.

Embodiment 2

The coil 2B included in the reactor 1B of Embodiment 2 is different from the above-described coil 2A in that the coil 2B includes two winding wires 2*wa* and 2*wb*. Wound portions 2*a* and 2*b* included in the coil 2B respectively include the winding wires 2*wa* and 2*wb*, which are different from each other. The coil 2B includes a connecting portion 2*j*B that electrically connects the end portions of the winding wires 2*wa* and 2*wb*.

In the winding wires 2*wa* and 2*wb* included in the wound portions 2*a* and 2*b*, one end portion is used as a portion to be connected to an external device, and the other end portion is used as a portion for formation of the connecting portion 2*j*B. In this embodiment, the other end portion of one of the winding wires, namely the winding wire 2*wa*, includes a portion extending upward, a portion extending toward the other of the wound portions, namely the wound portion 2*b*, and portions bent to form these two portions, and is formed in a reverse L-shape. The other end portion of the other of the winding wires, namely the winding wire 2*wb*, includes a portion extending upward as in the one end portion. The connecting portion 2*j*B includes a portion where the leading ends of the other end portions of the winding wires 2*wa* and 2*wb* are joined together. Both a direct joining process such as welding (e.g., TIG welding, laser welding, or resistance welding), crimping, cold welding, or vibration welding and an indirect joining process in which solder, a wax material, or the like is used can be used as the joining process. Moreover, the joining process may be performed before or after the coil 2B and the magnetic core 3 are assembled together. For example, the above-described joining process can be performed after the coil 2B and one of the split core pieces are attached to each other.

As in the case of the reactor 1A of Embodiment 1, with the reactor 1B of Embodiment 2, a forward magnetic flux coil is used as the coil 2B, and the magnetic core 3 having a specific shape is included, thus making it possible to reduce the installation height when the reactor 1B is arranged in the vertical layout. Moreover, with the reactor 1B, leakage flux can be reduced due to the magnetic core 3, and low loss is achieved. In particular, with the reactor 1B of Embodiment 2, the winding wires 2*wa* and 2*wb*, which are different from each other, are used to form the wound portions 2*a* and 2*b*. Therefore, the wound portions 2*a* and 2*b* are easily formed, and excellent manufacturability of the coil 2B is achieved. Also, since the other end portions of the winding wires 2*wa* and 2*wb* can be bent or folded back in a state in which adjacent wound portions are not present, and the connecting portion 2*j*B is thus easily formed, excellent manufacturability of the coil 2B is achieved. In addition, adjusting the lengths of the other end portions of the winding wires 2*wa* and 2*wb* constituting the connecting portions 2*j*B makes it possible to adjust the interval between the wound portions 2*a* and 2*b* with high accuracy, and perform adjustment corresponding to the size (including manufacturing error) of the magnetic core 3 to be assembled. Therefore, excellent accuracy of dimensions can be achieved in the reactor 1B.

Embodiment 3

The coil 2C included in the rector 1C of Embodiment 3 is different from the above-described coil 2A in that the connecting portion 2*j*C does not protrude from the magnetic core 3. The connecting portion 2*j*C of this embodiment includes a portion that is bent into an S-shape so as to extend from the lower end surface of one of the wound portions, namely the wound portion 2*a*, to the upper end surface of the other of the wound portions, namely the wound portion 2*b*. The height of the connecting portion 2*j*C is substantially the same as the heights $H_2$ of the wound portions 2*a* and 2*b*.

As in the case of the reactor 1A of Embodiment 1, with the reactor 1C of Embodiment 3, a forward magnetic flux coil is used as the coil 2C, and the magnetic core 3 having a specific shape is included, thus making it possible to reduce the installation height when the reactor 1C is arranged in the vertical layout. Moreover, with the reactor 1C, leakage flux can be reduced due to the magnetic core 3, and low loss is achieved. In particular, with the reactor 1C of Embodiment 3, the connecting portion 2*j*C does not substantially protrude from both the wound portions 2*a* and 2*b* and the magnetic core 3 in the height direction, and therefore, the installation height is lower. Adjusting the position at which the connecting portion 2*j*C is formed, the shape of the connecting portions 2*j*C, and the like as described above makes it possible to form the reactor 1C with which a lower installation height can be achieved. If the bending positions and the lengths of the extra portions at the other end portions of the winding wires 2*wa* and 2*wb*, which were descried in the above-described Embodiment 2, are adjusted, the connecting portion 2*j*B can be formed so as not to protrude from the magnetic core 3 in the height direction of the reactor 1B.

Embodiment 4

In Embodiments 1 to 3, the cases where all of the coils 2A to 2C are forward magnetic flux coils were described. An opposite magnetic flux coil in which magnetic fluxes passing through the wound portions 2*a* and 2*b* flow in opposite directions when an electric current is applied to the coil 2A or the like can be used instead of the forward magnetic flux coil. When a single winding wire 2*w* is used as in Embodiments 1 and 3 to form an opposite magnetic flux coil, a portion of the winding wire 2*w* that connects the wound portion 2*a* and 2*b* may be folded back such that magnetic fluxes passing through the wound portions 2*a* and 2*b* flow in opposite directions (see FIG. 1 and the like in JP 2016-122760A). When two winding wires 2*wa* and 2*wb* are used as in Embodiment 2 to form an opposite magnetic flux coil, it is sufficient that the winding wires 2*wa* and 2*wb* are wound in the same direction in the wound portion 2*a* and 2*b*, and the other end portion of one of the winding wires is folded back and the other end portions are joined together such that magnetic fluxes passing through the wound portions 2*a* and 2*b* flow in opposite directions. In addition, known opposite magnetic flux coils having various shapes can be used.

The reactor of Embodiment 4 including an opposite magnetic flux coil particularly includes the magnetic core 3 including the central leg portion 31 in addition to the inner leg portions 3*a* and 3*b* and the outer leg portions 32 and 33, thus making it possible to flow magnetic fluxes from the wound portions 2*a* and 2*b* in the central leg portion 31. Therefore, even when a larger electric current is applied, magnetic flux saturation is less likely to occur, and inductance is less likely to decrease.

MODIFIED EXAMPLES

At least one of the following modifications and additions can be made in the above-described Embodiments 1 to 4.

A sensor (not shown) for measuring a physical quantity in the reactor, such as a temperature sensor, a current sensor, a voltage sensor, or a magnetic flux sensor is provided.

Heat dissipation plates are provided at the exposed portions of the wound portions 2*a* and 2*b*.

An insulating intervention member such as a bobbin is provided instead of the resin molded portion.

Heat welded resin portions (not shown) that joins the adjacent turns included in the wound portions 2*a* and 2*b* are provided instead of the resin molded portion or in addition to the resin molded portion.

A case (made of a metal such as aluminum or an aluminum alloy) is provided in which the assembly including the coil 2A and the like and the magnetic core 3 is to be stored. Furthermore, a heat dissipation layer is provided between the assembly and the inner bottom surface of the case. Specific materials of the heat dissipation layer include those containing a filler (nonmagnetic nonmetallic powder made of alumina or the like) having excellent heat dissipation properties and resin (optionally an adhesive).

The present disclosure is not limited to these embodiments and is defined by the scope of the appended claims, and all changes that fall within the same essential spirit as the scope of the claims are intended to be included therein.

For example, a horizontal layout is also possible. In this case, configurations can be employed in which the exposed portions of the wound portions 2*a* and 2*b* are used as an installation surface, and one of the outer leg portions is used as an installation surface.

The invention claimed is:

1. A reactor comprising:

a coil including two wound portions obtained by winding a winding wire and a connecting portion that connects the wound portions; and a magnetic core in which the wound portions are arranged, wherein the winding wire is a coated wire including a conductive wire and an insulating coating that covers an outer periphery of the conductive wire, the magnetic core includes:

an inner leg portion arranged inside inner peripheries of the wound portions;

a central leg portion provided between the wound portions;

two outer leg portions that are provided outside outer peripheries of the wound portions and between which the inner leg portions and the central leg portion are provided; and two coupling portions between which the inner leg portions, the central leg portion, and the outer leg portions, which are arranged in parallel, are sandwiched and with which these portions are coupled, the central leg portion and the inner leg portions have substantially a same length, the outer leg portions have lengths that are longer than those of the central leg portion and the inner leg portions, and the coupling portions are provided with a cutout portion formed by cutting the coupling portions such that regions of the coupling portions in which the central leg portion is provided have lengths that are the same as those of the inner leg portions.

2. The reactor according to claim 1, wherein the magnetic core includes at least one of a composite material molded article containing magnetic powder and a resin, and a powder molded article.

3. The reactor according to claim 1, wherein the winding wires included in the wound portions are different, and the connecting portion includes a portion that directly or indirectly joins end portions of the winding wires.

4. The reactor according to claim 1, wherein the wound portions are connected such that magnetic fluxes passing through the wound portions flow in the same direction.

5. The reactor according to claim 1, wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

6. A magnetic core for a reactor to which a coil including two wound portions obtained by winding a winding wire and a connecting portion that connects the wound portions is assembled, the magnetic core comprising:

an inner leg portion arranged inside inner peripheries of the wound portions;

a central leg portion that is arranged apart from the inner leg portions and is provided between the inner leg portions;

two outer leg portions that are arranged apart from the inner leg portions and between which the inner leg portions and the central leg portion are provided; and two coupling portions between which the inner leg portions, the central leg portion, and the outer leg portions, which are arranged in parallel, are sandwiched and with which these portions are coupled, wherein the central leg portion and the inner leg portions have substantially a same length, the outer leg portions have lengths that are longer than those of the central leg portion and the inner leg portions, and the coupling portions are provided with cutout portions formed by cutting the coupling portions such that regions of the coupling portions in which the central leg portion is provided have lengths that are the same as those of the inner leg portions.

7. The reactor according to claim 2, wherein the winding wires included in the wound portions are different, and the connecting portion includes a portion that directly or indirectly joins end portions of the winding wires.

8. The reactor according to claim 2, wherein the wound portions are connected such that magnetic fluxes passing through the wound portions flow in the same direction.

9. The reactor according to claim 3, wherein the wound portions are connected such that magnetic fluxes passing through the wound portions flow in the same direction.

10. The reactor according to claim 3, wherein the wound portions are connected such that magnetic fluxes passing through the wound portions flow in the same direction and wherein the magnetic core includes at least one of a composite material molded article containing magnetic powder and a resin, and a powder molded article.

11. The reactor according to claim 2, wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

12. The reactor according to claim 3, wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

13. The reactor according to claim 3, wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion, and wherein the magnetic core includes at least one of a composite material molded article containing magnetic powder and a resin, and a powder molded article.

14. The reactor according to claim 4, wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

15. The reactor according to claim 4, wherein the winding wires included in the wound portions are different, and the connecting portion includes a portion that directly or indirectly joins end portions of the winding wires, and wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

16. The reactor according to claim 4, wherein the magnetic core includes at least one of a composite material molded article containing magnetic powder and a resin, and a powder molded article, and wherein the winding wires included in the wound portions are different, and the connecting portion includes a portion that directly or indirectly joins end portions of the winding wires, and wherein the magnetic core is constituted by an assembly of a pair of split core pieces, and each of the split core pieces includes one of the coupling portions, and two inner leg pieces that form portions of the inner leg portions, a central leg piece that forms a portion of the central leg portion, and two outer leg pieces that form portions of the outer leg portions, the inner leg pieces, central leg piece, and outer leg pieces rising from the coupling portion.

* * * * *